US005468592A

United States Patent [19]

Nii et al.

[11] Patent Number: 5,468,592

[45] Date of Patent: Nov. 21, 1995

[54] SILVER HALIDE PHOTOGRAPHIC MATERIAL

[75] Inventors: Kazumi Nii; Takashi Hoshimiya; Kazunobu Katoh; Toshihide Ezoe, all of Kanagawa, Japan

[73] Assignee: Fuji Photo Film Co. Ltd., Kanagawa, Japan

[21] Appl. No.: 220,641

[22] Filed: Mar. 31, 1994

[30] Foreign Application Priority Data

Mar. 31, 1993 [JP] Japan ..... 5-094925

[51] Int. Cl.[6] ..... G03C 1/06

[52] U.S. Cl. ..... 430/264; 430/598

[58] Field of Search ..... 430/264, 598

[56] References Cited

U.S. PATENT DOCUMENTS

| | | | |
|---|---|---|---|
| 4,971,890 | 11/1990 | Okada et al. | 430/264 |
| 5,026,622 | 6/1991 | Yamada et al. | 430/264 |
| 5,030,546 | 7/1991 | Takamuki et al. | 430/264 |
| 5,124,230 | 6/1992 | Okamura et al. | 430/264 |
| 5,130,480 | 7/1992 | Ruger | 430/264 |
| 5,147,756 | 9/1992 | Fodor | 430/264 |
| 5,190,847 | 3/1993 | Chan et al. | 430/264 |
| 5,204,213 | 4/1993 | Okada et al. | 430/264 |
| 5,284,732 | 2/1994 | Nii et al. | 430/264 |
| 5,288,590 | 2/1994 | Kuwabara et al. | 430/264 |

FOREIGN PATENT DOCUMENTS

| | | |
|---|---|---|
| 0126000 | 11/1984 | European Pat. Off. . |
| 0253665 | 1/1988 | European Pat. Off. . |
| 0311009 | 4/1989 | European Pat. Off. . |
| 0356898 | 3/1990 | European Pat. Off. . |
| 0356801 | 3/1990 | European Pat. Off. . |
| 0398355 | 11/1990 | European Pat. Off. . |
| 0420005 | 4/1991 | European Pat. Off. . |
| 0446078 | 9/1991 | European Pat. Off. . |

*Primary Examiner*—Thomas R. Neville
*Attorney, Agent, or Firm*—Sughrue, Mion, Zinn, Macpeak & Seas

[57] ABSTRACT

An ultra-hard silver halide photographic material having high processing stability, which contains a hydrazine derivative represented by the following general formula (1) or (2):

(1)

(2)

wherein $X^1$ and $X^2$ are each a group containing 1 to 6 carbon atoms, $Y^1$ is a hydrogen atom or a group, $R^1$ is a group, $Y^1$ and $R^1$ jointly provide 4 to 30 carbon atoms, $Y^2$ is an electron withdrawing group, $R^2$ is a hydrogen atom or a monovalent group, and n is an integer of from 1 to 5.

20 Claims, No Drawings

SILVER HALIDE PHOTOGRAPHIC MATERIAL

BACKGROUND OF THE INVENTION

1. Field of the Invention

The present invention relates to a silver halide photographic material. More particularly, it is concerned with a silver halide photographic material used in a photomechanical process.

2. Description of the Prior Art

In the field of graphic arts, image-forming systems which can ensure ultra-hard photographic characteristics (especially a gamma value of at least 10) are required for the purpose of satisfactory reproduction of continuous-tone images or line images in halftone images.

As for the method for obtaining high contrasty photographic characteristics by the use of a stable developer, there are known methods of respectively using the hydrazine derivatives disclosed (in a developer or a photographic material), e.g., in U.S. Pat. Nos. 4,224,401, 4,168,977, 4,166,742, 4,311,781, 4,272,606 and 4,211,857. According to these methods, ultra-hard and high-speed photographic characteristics can be achieved and, what is more, as it is allowable to add a sulfite in a high concentration to a developer, the stability to aerial oxidation of a developing agent in the developer is improved to a great extent, compared with that in a lith developer.

On the other hand, means for reducing changes in pH of a developer by aerial oxidation and processing of photosensitive materials are disclosed in JP-A-62-186259 and JP-A-60-93433 (the term "JP-A" as used herein means an "unexamined published Japanese patent application).

However, it has be revealed that success only in suppressing the conversion of a developing agent and the change in pH of a developer cannot lead to steady achievement of satisfactory photographic characteristics.

As a result of analyzing the cause of the aforesaid troubles, we have found that variation of the sulfite concentration also has an influence upon photographic characteristics. Since the influence of a variation of the sulfite concentration upon photographic characteristics is small in conventional ordinary development-processing systems, exclusive of lith development, it is beyond expectation that the variation of the sulfite concentration has a considerable influence in hard-tone enhanced systems utilizing nucleation with hydrazine derivatives.

In a lith development system, a sulfite can be used in an only slight amount. Therefore, the lith developer is designed so as to contain a sulfite in the form of an aldehyde adduct (including formaldehyde adduct), thereby minimizing the variation of a sulfite concentration. In the hard gradation system utilizing hydrazine nucleation, on the other hand, the developer used contains a sulfite in a high concentration. In such a system, the attempt to keep the sulfite concentration to be constant using the same -means as adopted in the lith development system is attended by various disadvantages.

Therefore, it is desired to use hydrazine nucleation compounds which is hard to undergo the influence of variation of the sulfite concentration.

Hydrazine derivatives having various structures have been used as nucleator.

There are disclosed the compounds represented by RNHNHCHO in JP-B-58-9410 (the term "JP-B" as used herein means an "examined Japanese patent publication), JP-B-58-30568 and U.S. Pat. No. 4,650,746, the compounds represented by $(R^1)(R^2)NCON(R^3)$-X-NHNHCHO in JP-B-59-52820, the compounds represented by $(R^1)(R^2)NCON(R^3)$-X-NHNHCOR$^4$ in JP-B-1-15855, and the compounds represented by $R^1NHCON(R^2)CO-(CH_2)_n$-Ar-NHNH-V-R$^5$ in JP-A-1-105943 (wherein R, $R^1$, $R^2$, $R^3$, $R^4$ and $R^5$ respectively represent a monovalent substituent, Ar represents an arylene group, the former X represents a bivalent aromatic group residue, the latter X represents a phenylene group, V represents —$SO_2$— or —CO—, and n represents an integer of from 1 to 10). In those references, it is disclosed that R, $R^1$ and $R^2$ each may contain a ballast group and a group capable of accelerating the adsorption of the compound onto silver halide grains which have been conventionally used in couplers. $R^4$ and $R^5$ each represents a hydrogen atom, an aliphatic group or an aromatic group, with specific examples including methyl and phenyl groups.

In addition, there are disclosed in JP-A-60-140340 the hydrazine derivatives represented by formula $R^1$-NHNH-G-$R^2$ wherein $R^1$ represents a substituted or unsubstituted aryl group, $R^2$ represents a hydrogen atom, or a substituted or unsubstituted alkyl, aryl or aryloxy group, and G represents —CO—, a sulfonyl group, a sulfoxy group, a phosphoryl group or an imino group. Therein, it is also described that in a preferred case $R^1$ may contain a ballast group or a group capable of accelerating the absorption onto silver halide grains.

Further, the compounds represented by Ar-NHNH-COR, wherein Ar contains a nondiffusible group (the same as a ballast group) or a group capable of adsorbing onto silver halide grains and R is a substituted alkyl group, are disclosed in JP-A-2-37.

The compounds represented by $(R^1)(R^2)NCON(R^3)$-$(A_2$-$L)_m$ -Ar-NHNH-Z (wherein $R^1$ and $R^2$ each represents a hydrogen atom, an alkyl group, an alkenyl group, an alkynyl group, an aryl group, a heterocyclic group or an amino group, $R^3$ represents a hydrogen atom or an alkyl group, $A_r$ and $A_2$ each represents an aryl group, or a heterocyclic group, L represents a linking group, Z represents a formyl group, an acyl group, a sulfonyl group, a carbamoyl group, a sulfamoyl group, an alkoxycarbonyl group, or a thioacyl group), wherein at least either $R^1$ or $R^2$ is an amino group, are disclosed in JP-A-2-947.

In U.S. Pat. Nos. 4,925,832 and 4,798,780 are disclosed the intramolecularly cyclized hydrazine compounds.

In U.S. Pat. No. 4,937,160 and European Patent 444,506 are disclosed the hydrazine compounds containing a pyridinium group.

Specific examples of the compounds disclosed in prior arts are illustrated below.

Comparative Compound A (disclosed in JP-A-1-105943)

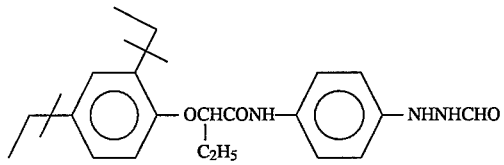

Comparative Compound B (disclosed in JP-A-60-140340)

-continued

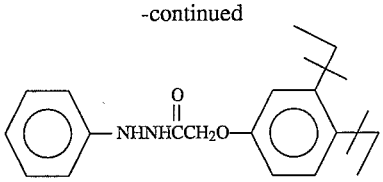

Comparative Compound C (disclosed in JP-A-60-140340)

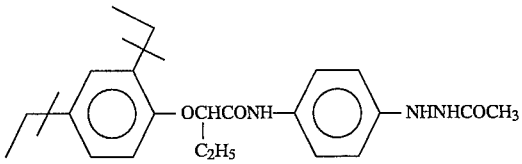

Comparative Compound D (disclosed in JP-A-62-247351)

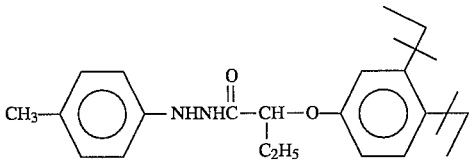

Comparative Compound E (disclosed in JP-A-2-947)

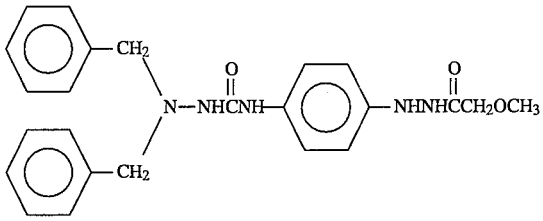

Comparative Compound F (disclosed in U.S. Pat. No. 4,925,832)

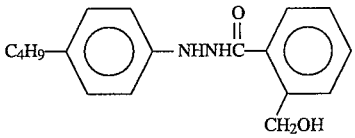

Comparative Compound G (disclosed in JP-A-2-120736)

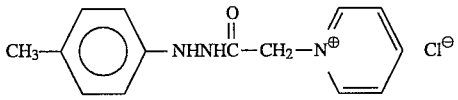

However, some of these known hydrazine compounds cannot exhibit sufficient nucleation activity, while others cannot fulfil the new requirement for sulfite concentration independency although they have high nucleation activity.

SUMMARY OF THE INVENTION

Therefore, a first object of the present invention is to provide a photosensitive material for graphic arts which has high processing stability, especitialy, has low sulfite concentration dependency.

A second object of the present invention is to provide a novel nucleating agent.

These objects of the present invention are attained with a silver halide photographic material having on a support at least one light-sensitive silver halide emulsion layer, which contains in at least one of said at least one emulsion layer and a hydrophilic colloid layer adjacent thereto at least one compound selected from the group consisting of compounds represented by general formulae (1) and (2):

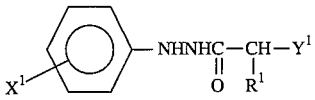

(1)

wherein $X^1$ represents an alkyl group, an alkoxy group, a substituted amino group or an alkylthio group, said groups represented by $X^1$ may have a substituent, and the total number of carbon atoms contained in $X^1$, including their substituents, ranges from 1 to 6; and $Y^1$ represents an alkoxy group, an aryloxy group, a substituted amino group, an alkylthio group or an arylthio group, and $R^1$ represents a hydrogen atom, an alkyl group or an aryl group, said groups represented by $Y^1$ and $R^1$ may have a substituent and the total number of carbon atoms contained in $Y^1$ and $R^1$ including their substituents, ranges from 4 to 30:

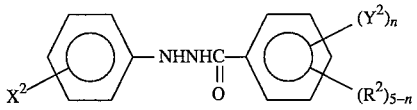

(2)

wherein $X^2$ has the same meaning as $X^1$ in general formula (1); $Y^2$ represents an electron withdrawing group; $R^2$ represents a hydrogen atom, an alkyl group, an aryl group, an alkoxy group, an aryloxy group, a substituted amino group, an alkylthio group or an arylthio group, said groups represented by $R^2$ may be substituted; n represents an integer of from 1 to 5; and a plurality of groups represented by $Y^2$ and/or groups represented by $R^2$ present in a molecule may respectively be the same or different.

DETAILED DESCRIPTION OF THE INVENTION

Now, the compounds of the present invention are illustrated below in detail.

In the general formulae (1) and (2), the alkyl group represented-by or included in $X^1$, $X^2$, $Y^1$, $Y^2$, $R^1$ and $R^2$ and the alkyl moiety contained in the alkoxy or alkylthio group represented by $X^1$, $X^2$, $Y^1$, $Y^2$, $R^1$ and $R^2$ are a straight-chain, branched or cyclic alkyl group, with typical examples including ethyl, butyl, isopropyl, isobutyl, t-amyl, cyclohexyl and like groups, and examples of the aryl group and the aryl moiety in the general formulae (1) and (2) include a phenyl and naphthyl groups and moieties thereof, respectively, if otherwise not defined.

Furthermore, an acyl group and an acyl moiety in the general formulae (1) and (2) represent an alkycarbonyl and arylcarbonyl groups and an alkylcarbonyl and arylcarbonyl moieties, respectively, if otherwise not defined.

Substituent(s) contained in the substituted amino group represented by $X^1$ include (i) an alkyl group and an aryl group (such as a phenyl group), and (ii) an acyl group (of formula R—CO—, wherein R is an alkyl group), an alkoxycarbonyl group, a substituted (for example, with an alkyl group) or unsubstituted carbamoyl group, a substituted (for example, with an alkyl group) or unsubstituted hydrazinocarbonyl group, an alkylsulfonyl group, an arylsulfonyl group, a substituted (for example, with an alkyl or aryl group) or unsubstituted sulfamoyl group, and so on. The substitution with a group included in the latter case (ii) results in formation of a carbonamido group, an urethane group (i.e., an alkoxy carbonylamino group), an ureido group, a semicarbazido group, a sulfonamido group or so on.

$X^1$ may further once or twice be substituted with at least one of , for example, an alkyl group, an alkoxy, an alkoxyalkoxy group, an aryloxy group, an aryl group and a hydroxy gorup. Examples of the substituted groups include 2 -methoxyethoxy group and 3,3-bis(2-hydroxyethyl)ureido group. Both of two hydrogen atoms in the amino moiety in the carbamoyl group or the hydrazinocarbonyl may be substituted with an alkylene group or an alkyl amino dialkylene group to form a heterocycric ring.

The total number of carbon atoms contained in $X^1$, inclusive of substituent(s) thereof, is in the range of 1 to 6, preferably 2 to 6, and particularly preferably 3 to 6.

The group preferred as $X^1$ is a substituted amino group, especially an amino group substituted so as to form a carbonamido group, an ureido group or a sulfonamido group.

The substitution position of $X^1$ on the phenyl group may be any of the positions ortho, meta and para to the hydrazino moiety. However, the meta position and the para position are preferable, and the para position is the best.

The phenylene group connecting $X^1$ to the hydrazino moiety may be further substituted. Examples of the substituent are the same as those defined by $X^1$. In case the phenylene group has substituent(s), it is desirable that the total number of carbon atoms contained in the substituent(s) and $X^1$ be in the range of 1 to 6.

The alkyl moiety contained in an alkoxy or alkylthio group represented by $Y^1$ in general formula (1) may have any of straight-chain, branched and cyclic forms. Typical examples of the alkyl moiety include methyl, dodecyl, isobutyl, 2-ethylhexyl and so on. The aryl moiety contained in an aryloxy or arylthio group is preferably a monocyclic or bicyclic unsaturated carbon ring residue or unsaturated hetero ring residue. Typical examples of such a ring residue include a benzene ring, a naphthalene ring, a pyridine ring, a quinolyne ring and so on.

Substituent group(s) contained in the substituted amino group represented by $Y^1$ include (i) conventional ones such as an alkyl group and an aryl group, and (ii) an acyl group of an alkyl or aryl group (i.e., an alkylcarbonyl or arylcarbonyl group), an alkoxycarbonyl or aryloxycarbonyl group, a substituted (for example, with an alkyl or aryl group) or unsubstituted carbamoyl group, a substituted (for example, with an alkyl or aryl group) or unsubstituted hydrazinocarbonyl group, an alkylsulfonyl group, an arylsulfonyl group, a substituted (for example, with an alkyl or aryl group) or unsubstituted sulfamoyl group, and so on. The substitution with a group included in the latter case (ii) results in formation of a carbonamido group, an urethane group (such as an alkoxycarbonylamino group and an aryloxycarbonylamino group), an ureido group, a semicarbazido group, a sulfonamido group or so on.

Groups preferred as $Y^1$ are an alkoxy group and an aryloxy group, especially an aryloxy group.

The group represented $Y^1$ may have substituent(s). Typical representatives of such substituent(s) are an alkyl group, an aralkyl group, an alkenyl group, an alkinyl group, an alkoxy group, an aryl group, a substituted amino group (examples of the substituent include those which are cited above as examples of the substituent of the substituted amino group represented by $Y^1$), an ureido group, an urethane group (i.e., a carbamoyloxy group or an alkoxy- or aryloxy-amino group), an aryloxy group, a sulfamoyl group, a carbamoyl group, an alkylthio group, an arylthio group, an alkylsulfonyl group, an arylsulfonyl group, an alkylsulfinyl group, an arylsulfinyl group, a hydroxy group, a halogen atom (e.g., Cl, Br, F and I), a cyano group, a sulfo group (i.e., —$SO_3M$ wherein M represents a hydrogen atom, an alkali metal atom such as Na and K, or $NH_4$), an aryloxycarbonyl group, an acyl group, an alkoxycarbonyl group, an acyloxy group, a carbonamido group (such as an alkyl- and arylcarbonamido groups), a sulfonamido group (such as an alkyl- and aryl-sulfonamido group), a carboxyl group (e.g., —COOM wherein M represents a hydrogen atom, an alkali metal atom such as Na and K, or $NH_4$), a phosphonamido group, a diacylamino group, an imido group and so on. Among these substituents, those favored in particular are an alkyl group (preferably containing 1 to 20 carbon atoms), an aralkyl group (preferably containing 7 to 30 carbon atoms), an alkoxy group (preferably containing 1 to 20 carbon atoms), a substituted amino group (whose substituent is preferably an alkyl group containing 1 to 20 carbon atoms), an acylamino group (preferably containing 2 to 30 carbon atoms), a sulfonamido group (preferably containing 1 to 30 carbon atoms), an ureido group (preferably containing 1 to 30 carbon atoms) and a phosphonamido group (preferably containing 1 to 30 carbon atoms). These groups may further be substituted with, for example, an alkoxy group and an alkoxyalkoxy group.

The alkyl group represented by $R^1$ in general formula (1) includes straight-chain, branched and cyclic alkyl groups. The representatives of these alkyl groups are methyl, dodecyl, isobutyl, 2-ethylhexyl and so on. The aryl group represented by $R^1$ includes residues of mono- and dicyclic unsaturated carbon rings, and residues of unsaturated hetero rings. Typical examples of such rings include a benzene ring, a naphthalene ring, a pyridine ring and a quinoline ring.

$R^1$ may have a substituent, and typical examples of such a substituent include those cited above as specific examples of a substituent which $Y^1$ may have.

It is preferable for $R^1$ to be a hydrogen atom. The total number of carbon atoms contained in $Y^1$and $R^1$ (including their substituents) ranges preferably from 6 to 30, particularly preferably from 8 to 20.

In general formula (2), the group represented by $X^2$ has the same definition as $X^1$ in general formula (1). Further, the description given above as to the preferred embodiments of $X^1$ can be applied to $X^2$ as it is.

The electron withdrawing group represented by $Y^2$ in general formula (2) includes groups having a substituent constant value $\sigma_m$ or $\sigma_p$ defined by Hammett of at least 0.2, preferably at least 0.3, and preferably not more than 0.9. As for the substitution position, $Y^2$ is preferably situated at the position meta to the carbonyl group when it has a $\sigma_m$ value of at least 0.2 (preferably at least 0.3), while it is preferably situated at the position para to the carbonyl group when it has a $\sigma_p$ value of at least 0.2 (preferably at least 0.3). When $\sigma_m$ and $\sigma_p$ values of $Y^2$ are both at least 0.2 (preferably 0.3), on the other hand, the positions meta and/or para to the carbonyl group are favored.

Typical examples of an electron withdrawing group represented by $Y^2$ include a sulfamoyl group, a carbamoyl group, an alkylsulfonyl group, an arylsulfonyl group, an alkylsulfinyl group, an arylsulfinyl group, a halogen atom (such as Cl, Br, F, and I), a cyano group, an alkyloxycarbonyl group, an aryloxycarbonyl group, an acyl group, a polyfluoroalkyl and polyfluoroaryl group.

Also, $Y^2$ may have a substituent. Typical examples of such a substituent include the groups cited as examples of a substituent which $Y^1$ may have.

Of the electron withdrawing groups cited above, a halogen atom (e.g., Cl, Br, F and I), an alkoxycarbonyl group and a cyano group are especially preferred as $Y^2$.

In general formula (2), the alkyl group represented by $R^2$ and the alkyl moiety in the alkoxy or alkylthio group represented by $R^2$ may be any of straight-chain, branched and cyclic. Typical examples of such an alkyl group or moiety include methyl, dodecyl, isobutyl, 2-ethylhexyl and so on. The aryl group represented by $R^2$ and the aryl moiety in the aryloxy or arylthio group represented by $R^2$ includes residues of mono- and dicyclic unsaturated carbon rings, and residues of unsaturated hetero rings. Typical examples of such rings include a benzene ring, a naphthalene ring, a pyridine ring and a quinoline ring.

Substituent group(s) contained in the substituted amino group represented by $R^2$ include (i) conventional ones such as an alkyl group and an aryl group, and (ii) an acyl group of an alkyl or an aryl group (i.e., alkylcarbonyl group, or an arylcarbonyl group), an alkoxycarbonyl group, an aryloxycarbonyl group, a substituted (for example, with an alkyl or aryl group) or unsubstituted carbamoyl group, a substituted (for example, with an alkyl or aryl group) or unsubstituted hydrazinocarbonyl group, an alkylsulfonyl group, an arylsulfonyl group, a substituted (for example, with an alkyl or aryl group) or unsubstituted sulfamoyl group, and so on. The substitution with a group included in the latter case (ii) results in formation of a carbonamido group, an urethane group (i.e., alkoxy- or aryloxy-carbonylamino group), an ureido group, a semicarbazido group, a sulfonamido group or so on.

$R^2$ may have a substituent, and typical examples of such a substituent include those cited above as specific examples of a substituent which $Y^1$ in general formula (1) may have.

It is preferable for $R^2$ to be a hydrogen atom. The total number of the carbon atoms contained in all $Y^2$ groups and all $R^2$ groups (including their substituents) is preferably in the range of 6 to 30, and particularly preferably in the range of 8 to 20.

Specific examples of the compounds used in the present invention are illustrated below. However, the invention should not be construed as being limited to these examples.

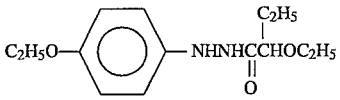

Compound 1

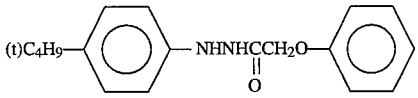

Compound 2

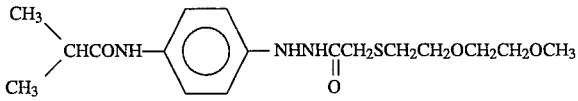

Compound 3

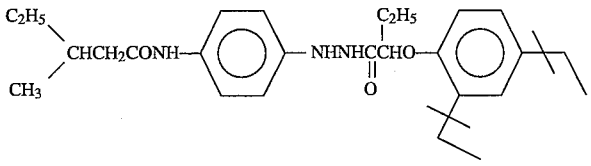

Compound 4

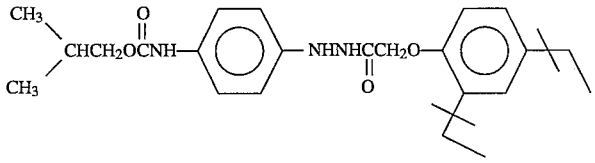

Compound 5

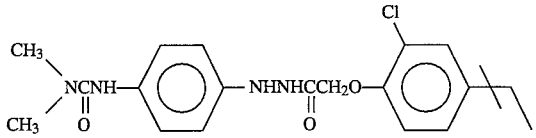

Compound 6

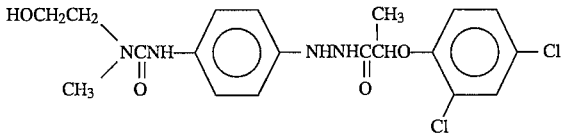

Compound 7

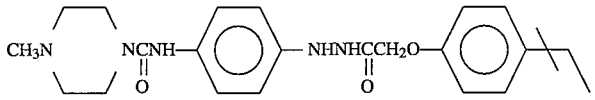

Compound 8

-continued
Compound 9
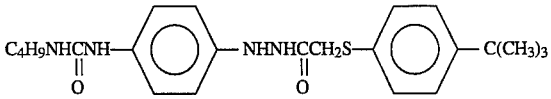
Compound 10
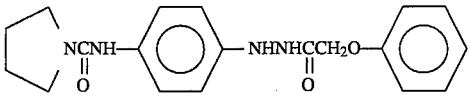
Compound 11
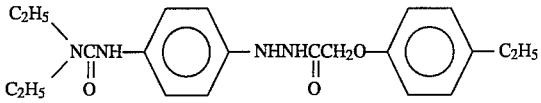
Compound 12
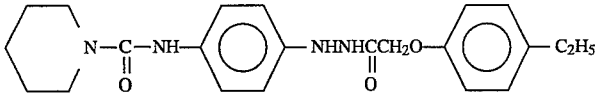
Compound 13
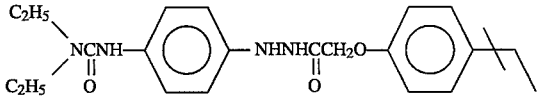
Compound 14
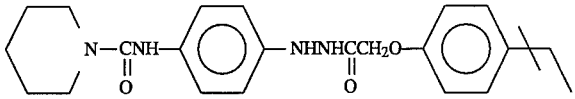
Compound 15
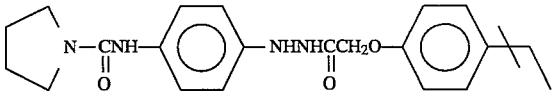
Compound 16
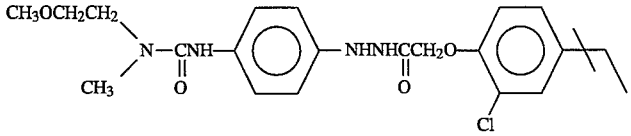
Compound 17
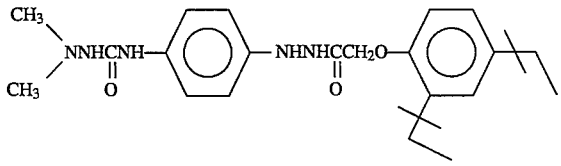
Compound 18
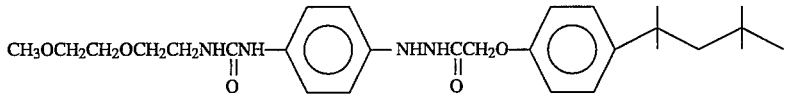
Compound 19
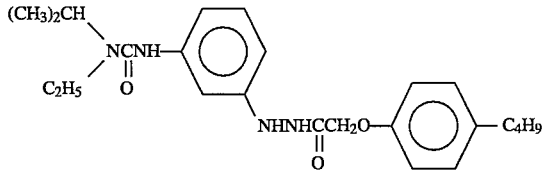
Compound 20
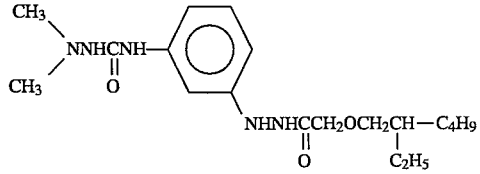

-continued

Compound 21

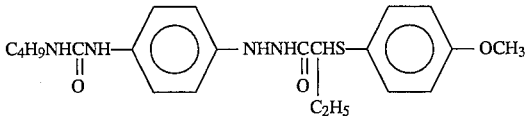

Compound 22

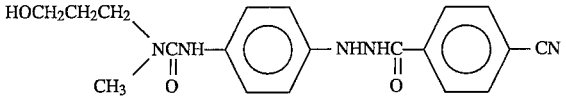

Compound 23

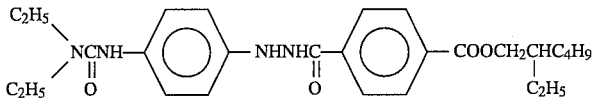

Compound 24

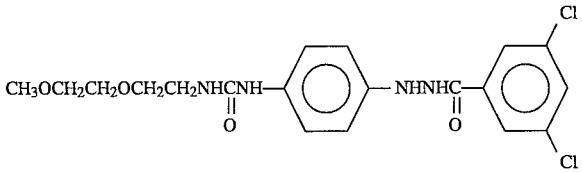

Compound 25

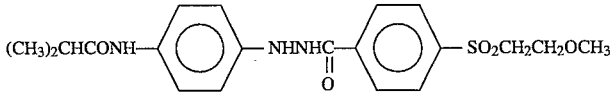

Compound 26

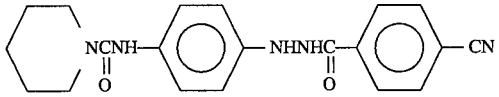

Compound 27

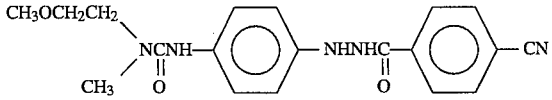

Compound 28

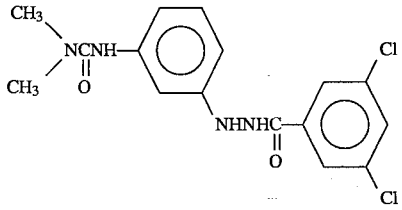

Compound 29

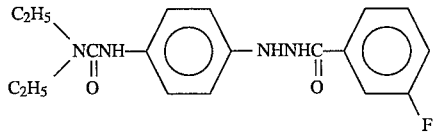

Compound 30

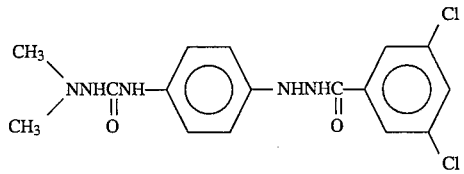

The hydrazine compounds used in the present invention are synthesized using the methods as disclosed in JP-A-61-213847, JP-A-62-260153, U.S. Pat. No. 4,684,604, JP-A-01-269936, U.S. Pat. Nos. 3,379,529, 3,620,746, 4,377,634 and 4,332,878, JP-A-49-129536, JP-A-56-153336, JP-A-56-153342, U.S. Pat. Nos. 4,988,604 and 4,994,365, and so on.

Specifically, the syntheses thereof are described below by taking the following two compounds as examples.

SYNTHESIS EXAMPLE 1

Synthesis of Compound 13 exemplified above:

Into a solution containing imidazole (157 g) dissolved in tetrahydrofuran (1.5 l) was added Starting Material A (300 g) as illustrated below under cooling to 0° C. with stirring in an atmosphere of nitrogen. After the temperature of the resulting solution was raised to room temperature, the solution was stirred for 2 hours. Thereafter, p-nitrophenylhydrazine (153 g) dissolved in tetrahydrofuran (200 ml) was added to the reaction solution. The reaction solution was allowed to stand for one night, and then poured into water (3 l). The thus precipitated crystals were filtered off, washed successively with water and acetonitrile, and then dried under reduced pressure. Thus, an Intermediate A (346 g) illustrated below was obtained.

Starting Material A

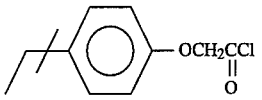

Intermediate A

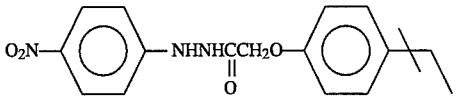

A mixture of Intermediate A (150 G), ammonium chloride (15 g), isopropyl alcohol (1.5 l) and water (150 ml) was heated under reflux in an atmosphere of nitrogen. To the refluxing mixture, reduced iron (150 g) was added gradually. After 1 hour heating under reflux, the resulting mixture was filtered with Celite to remove the insoluble matter. Upon cooling the obtained filtrate with stirring, crystals were deposited. These crystals were filtered off, and dried under reduced pressure to give Intermediate B (98 g) illustrated below.

Intermediate B

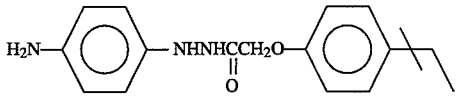

Triethylamine (8.0 ml) was added to a mixture of Intermediate B (18.0 g) with dimethylacetamide (100 ml) under cooling to 0° C. and stirring the solution, and subsequently thereinto was dropped N,N-dimethylcarbamoyl chloride (5.9 g). The temperature of resulting mixture was raised to room temperature and allowed to stand for one night. After completion of the reaction, the obtained reaction solution was poured into 0.5N aqueous solution of hydrochloric acid, extracted with ethyl acetate, washed with saturated brine, and dried over anhydrous magnesium sulfate. Then, the ethyl acetate was removed by distillation. The thus obtained matter was subjected to column chromatography on silica gel to isolate and to purify the product. Thus, the desired Compound 13 (9.2 g) was obtained. The chemical structure of the obtained product was ascertained by the measurements of NMR and IR spectra. m.p. 138°–139° C.

SYNTHESIS EXAMPLE 2

Synthesis of Compound 27 exemplified above:

P-cyanobenzoyl chloride (310 g) was added to a solution of imidazole (256 g) dissolved in tetrahydrofuran (1.2 l) under cooling to 0° C. with stirring in an atmosphere of nitrogen. The temperature of the resulting solution was raised to room temperature and stirred for 1 hour. Thereafter, p-nitrophenylhydrazine (250 g) dissolved in tetrahydrofuran (300 ml) was further added. The reaction solution was allowed to stand for one night, and then poured into 0.1N aqueous solution of hydrochloric acid (3 l). The thus precipitated crystals were filtered off, washed successively with water and acetonitrile, and then dried under reduced pressure. Thus, Intermediate C (430 g) illustrated below was obtained.

Intermediate C

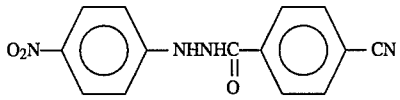

A mixture of Intermediate C (50 g), ammonium chloride (5 g), isopropyl alcohol (500 ml) and water (50 ml) was heated under reflux in an atmosphere of nitrogen. To the refluxing mixture, reduced iron (50 g) was added gradually. After 2 hours' heating under reflux, the resulting mixture was filtered with Celite to remove the insoluble matter. The obtained filtrate was cooled with stirring, and thereby crystals were precipitated. These crystals were filtered off, and dried under reduced pressure to give Intermediate D (35 g) illustrated below.

Intermediate D

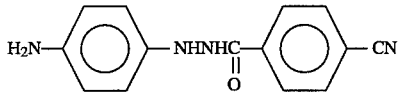

Pyridine (27 ml) was added to a mixture of Intermediate D (77 g), dimethylacetamide (300 ml) and acetonitrile (300 ml) in an atmosphere of nitrogen. Into the resulting solution was dropped phenyl chloroformate (50 g) under cooling (down to −10° C. or lower) and stirring. The resulting mixture was warmed up to room temperature, and the stirring was continued for 30 minutes. After the completion of the reaction, the reaction mixture was poured into 0.1N aqueous solution of hydrochloric acid to precipitate crystals. The crystals were washed successively with isopropyl alcohol and hexane, and dried under reduced pressure. Thus, Intermediate E (108 g) illustrated below was obtained.

Intermediate E

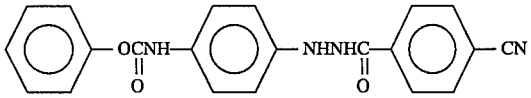

A mixture of N-methoxyethyl-N-methylamine (2.8 g), Intermediate E (11.2 g), imidazole (6.1 g) and acetonitrile (50 ml) was stirred for 5 hours at 50° C. in an atmosphere of nitrogen. After the completion of the reaction, the reaction mixture was poured into 0.1N aqueous solution of hydrochloric acid, extracted with ethyl acetate, washed with saturated brine, and dried over anhydrous magnesium sulfate. Then, the ethyl acetate was removed by distillation. The thus obtained matter was subjected to column chromatography on silica gel to isolate and to purify the product. Thus, the desired Compound 27 (5.5 g) was obtained. The chemical structure of the obtained product was ascertained by the measurements of NMR and IR spectra. m.p. 85°–88° C.

The hydrazine derivatives represented by formula (1) or (2) is preferably incorporated into the photographic material in an amount ranging from $1\times10^{-6}$ to $5\times10^{-2}$ mole, particularly from $1\times10^{-5}$ to $2\times10^{-2}$, per mole of silver halide in the photographic material.

The hydrazine derivatives may be used by dissolving in an appropriate water-miscible solvent, such as an alcohol (e.g., methanol, ethanol, propanol, fluorinated alcohols), a ketone (e.g., acetone, methyl ethyl ketone), dimethylformamide, dimethyl sulfoxide, methyl cellosolve, or so on.

Prior to the addition, on the other hand, the hydrazine derivatives can be dispersed in an emulsified state using a well-known emulsifying dispersion method, wherein they are dissolved in an oil, such as dibutyl phthalate, tricresl phosphate, glyceryl triacetate, diethyl phthalate or the like, together with an auxiliary solvent, such as ethyl acetate, cyclohexanone or so on, and then dispersed mechanically. Also, powder of the hydrazine derivatives can be dispersed into water using a ball mill, a colloid mill or ultrasonic waves according to a known solid dispersion method.

The silver halide used in the present invention may be any of silver chloride, silver bromide, silver chlorobromide, silver iodobromide, silver iodochlorobromide and so on.

As for the average grain size, it is preferable that the silver halide used in the present invention be fine grains (e.g., those having an average grain size of 0.7 μm or less), particularly 0.5 μm or less in average grain size. As to the distribution of sizes among grains, there is no particular restriction, however, it is preferable for the silver halide grains to be a monodisperse. The term "a monodisperse" as used herein means that at least 95% by weight or number of the grains have their individual sizes within the range of ±40% of the average grain size.

The silver halide grains in photographic emulsions may have a regular crystal form, such as that of a cube or an octahedron; an irregular crystal form, such as that of a sphere, a plate or so on; or a composite form of these crystal forms.

The interior and the surface of the silver halide grains may differ, or the silver halide grains may be uniform throughout.

Two or more kinds of silver halide emulsions prepared separately may be used in the form of mixture.

In a process of producing silver halide grains to constitute the silver halide emulsions used in the present invention or phisical ripenning of silver halide grains, cadmium salts, zinc salts, lead salts, thallium salts, rhodium salts or complexes, iridium salts or complexes, and/or the like may be present.

The emulsion layers of the present invention or other hydrophilic colloid layers may contain water-soluble dyes as filter dyes or for various other purposes including the prevention of irradiation. Suitable examples of such filter dyes include dyes for further lowering the photographic speed, preferably ultraviolet absorbents having their spectral absorption maxima in the intrinsic sensitivity region of silver halides and dyes for heightening the safety to the light of a safety lamp used dealing with the photosensitive material as daylight material which therefore have their substantial absorption mainly in the wavelength region of from 350 to 600 nm.

Those water-soluble dyes may be added to emulsion layers, if desired. Also, it is desirable that they be added together with a mordant to a light-insensitive hydrophilic colloid layer provided on the upper side of a silver halide emulsion layer, i.e., the side of the silver halide emulsion layer away from the support, whereby they are fixed to the hydrophilic colloid layer.

In using those dyes, on the other hand, they can be dispersed into gelatin in the form of microcrystals, as disclosed in European Patent 276,566 and WO 88/04794.

The addition amount of such dyes, though depends on their molar extinction coefficients, is generally in the range of $10^{-2}$ to 1 g/m$^2$, and preferably in the range of 50 to 500 mg/m$^2$.

Specific examples of such dyes are fully illustrated in JP-A-63-64039 (U.S. Pat. No. 4,908,293).

In adding such dyes to a coating solution for the light-insensitive hydrophilic colloid layer in the photographic material of the present invention, they are dissolved in an appropriate solvent [e.g., water, an alcohol (e.g., methanol, ethanol, propanol), acetone, methyl cellosolve, a mixture of two or more thereof].

Those dyes can be used alone or as a mixture of two. or more thereof.

In the present invention, the dyes may be used in an amount required for making it possible to handle the resulting photographic material under daylight.

Specifically, the amount suitable for the foregoing requirement can be found generally in the range of $10^{-3}$ to 1 g/m$^2$, and particularly in the range of $10^{-3}$ to 0.5 g/m$^2$.

As for the binder or protective colloid used for photographic emulsions, or as for the binder used as a mixture with deacetyllated chitin in a protective or overcoat layer, gelatin is used to advantage. Of course, hydrophilic colloids other than gelatin can be used. Specific examples of such colloids include proteins such as gelatin derivatives, graft polymers prepared from gelatin and other high molecular compounds, albumin, casein, etc.; sugar derivatives such as cellulose derivatives (e.g., hydroxyethyl cellulose, carboxymethyl cellulose, cellulose sulfate), sodium alginate, starch derivatives, etc.; and various kinds of synthetic hydrophilic high molecular substances including homopolymers and copolymers, such as polyvinyl alcohol, partial acetals of polyvinyl alcohol, poly-N-vinylpyrrolidone, polyacrylic acid, polymethacrylic acid, polyacrylamide, polyvinylimidazole, polyvinylpyrazole, etc.

As for the gelatin, not only lime-processed gelatin but also acid-processed gelatin may be used. In addition, hydrolysis products of gelatin and enzymatic degradation products of gelatin can be used, too.

While the silver halide emulsions used in the present invention may be chemically unsensitized ones, they can be chemically sensitized. Known methods for the chemical sensitization include sulfur sensitization, reduction sensitization and noble metal sensitization methods. These methods can be used independently or as a combination thereof.

One of representatives of noble metal sensitization methods is a gold sensitization method in which gold compounds, mainly gold complex salts, are used. In the gold sensitization, complex salts of noble metals other than gold, such as platinum, palladium, iridium and the like, may be used together. Specific examples of such sensitization methods include those disclosed, e.g., in U.S. Pat. No. 2,448,060 and U.K. Patent 618,061.

As for the sulfur sensitizer used in the sulfur sensitization method, there can be used not only sulfur compounds contained in gelatin but also various kinds of sulfur compounds including thiosulfates, thioureas, thiazoles and rhodanines.

As for the reducing materials used in the reduction sensitization method, there can be used stannous salts, amines, formamidinesulfinic acid, silane compounds and so on.

To the silver halide emulsion layers used in the present invention, known spectral sensitizing dyes may be added.

The photographic material of the present invention can contain a wide variety of compounds for the purpose of preventing fog or stabilizing photographic properties during production, storage or photographic processing thereof. Specifically, it can contain azoles such as benzothiazolium salts, nitroindazoles, chlorobenzimidazoles, bromobenzimidazoles, mercaptothiazoles, mercaptobenzothiazoles, mercaptothiadiazoles, aminotriazoles, benzothiazoles, nitrobenzotriazoles, etc.; mercaptopyrimidines; mercaptotriazines; thioketo compounds such as oxazolinethione; azaindenes, such as triazaindenes, tetraazaindenes (especially 4-hydroxy-substituted (1,3,3a,7 )-tetraazaindenes), pentaazaindenes, etc.; and any compounds which have been known as antifoggant or stabilizer, such as benzenethiosulfonic acid, benzenesulfinic acid, benzenesulfonamide, etc. Of the above-cited compounds, benzotriazoles (e.g., 5-methyl-benzotriazole) and nitroindazoles (e.g., 5-nitroindazole) are favored in particular. Also, these compounds may be contained in a processing solution.

The photographic light-sensitive material of the present invention may contain an inorganic or organic hardener in photographic emulsion layers or other hydrophilic colloid layers. Specific examples of such hardeners include chromium salts (e.g., chrome alum), aldehydes (e.g., glutaraldehyde), N-methylol compounds (e.g., dimethylol urea), dioxane derivatives, active vinyl compounds (e.g., 1,3,5-triacryloyl-hexahydro-s-triazine, 1,3-vinylsulfonyl-2propanol), active halogen-containing compounds (e.g., 2,4-dichloro-6-hydroxy-s-triazine), mucohalogenic acids, and so on. These hardeners can be used alone, or as a mixture of two or more thereof.

The photographic emulsion layers and other hydrophilic colloid layers of the photosensitive material of the present invention can contain various kinds of surfactants for a wide variety of purposes, for instance, as a coating aid, prevention of electrification, improvement in slippability, emulsifying dispersion, prevention of adhesion, improvements in photographic characteristics (e.g., acceleration of development, increase in contrast, sensitization), and so on.

Suitable examples of a surfactant which can be used include nonionic surfactants such as saponin (steroid type), alkylene oxide derivatives (e.g., polyethylene glycol, polyethylene glycol/polypropylene glycol condensates, polyethylene glycol alkyl ethers or polyethylene glycol alkyl alkohol ethers, polyethylene glycol esters, polyethylene glycol sorbitan esters, polyalkylene glycol alkylamines or amides, polyethylene oxide adducts of silicone, etc.), glycidol derivatives (e.g., alkenylsuccinic acid glyceride, alkylphenol polyglyceride, etc.), fatty acid esters of polyhydric alcohols, alkyl esters of sugars, and so on; anionic surfactants containing acid groups such as a carboxylic acid, a sulfo group, a phospho group, a sulfuric ester group, a phosphoric ester group, etc., including alkyl carboxylates, alkyl sulfonates, alkylbenzene sulfonates, alkylnaphthalene sulfonates, alkylsulfuric esters, alkyl phosphoric esters, N-acyl-N-alkyltaurines, sulfosuccinates, sulfoalkylpolyoxyethylene alkyl phenyl ethers, polyoxyethylene alkylphosphosphoric esters and the like; amphoteric surfactants such as amino acids, aminoalkylsulfonic acids, aminoalkylsulfuric or phosphoric esters, alkylbetaines, amine oxides, and so on; and cationic surfactants such as alkylamine salts, aliphatic or aromatic quaternary ammonium salts, heterocyclic quaternary ammonium salts including pyridinium, imidazolium and so on, and aliphatic or hetero ring-containing phosphonium or sulfonium salts.

Surfactants preferred in particular in the present invention are the polyalkylene oxides having a molecular weight of at least 600, as disclosed in JP-B-58-9412 (U.S. Pat. No. 4,221,857; the term "JP-B" as used herein means an "examined Japanese patent publication). In addition, the photographic material can contain polymer latexes such as polyalkylacrylate for the purpose of dimensional stability.

Development accelerators or accelerators of nucleation infectious development which are suitable for the present invention are the compounds disclosed in JP-A-53- 77616 (U.S. Pat. No. 4,237,214), JP-A-54-37732 (U.S. Pat. No. 4,221,857), JP-A-53-137133 (U.S. Pat. No. 4,272,606), JP-A-60- 140340, JP-A-60-14959 (U.S. Pat. No. 4,699,873) and so on. Further, various kinds of nitrogen- or sulfur-containing compounds are effective in accelerating the development.

The optimal amount of an accelerator added depends on the species of the compound used. Specifically, it is desirable that the accelerator be used in an amount ranging from $1.0\times10^{-3}$ to 0.5 g/m$^2$, preferably from $5.0\times10^{-3}$ to 0.1 g/m$^2$. The accelerator is dissolved in an appropriate solvent (e.g., water, alcohols including methanol, ethanol and the like, acetone, dimethylformamide, methyl cellosolve), and then added to a coating composition.

The additives as described above may be used in combination of two or more different kinds.

Examples of the hydrophilic colloid layer adjacent to a silver halide emulsion layer in the photographic material of the present invention include a protective layer, a subbing layer, an untihalation layer, an intermediate layer, and an irradiation preventing layer.

For obtaining ultra-hard photographic characteristics using the silver halide photographic material of the present invention, it is not required to use conventional infectious developers or highly alkaline developers having a pH value close to 13 as disclosed in U.S. Pat. No. 2,419,975, but stable developers can be used.

More specifically, the silver halide photographic material of the present invention can provide a sufficiently ultra-hard negative image by the use of a developer containing sulfite ion as a preservative in an amount of at least 0.10 mole per liter (preferably not more than 1.0 mole per liter) and being adjusted to pH 9.0–12.3, particularly pH 10.0–12.0.

There is not any particular restrictions with respect to the developing agent used for processing the photographic material of the present invention. In other words, it is possible to use various compounds recited as developing agent in T. H. James, *The Theory of the Photographic Process,* 4th ed., Macmillan Publishing Co., pp. 298–327.

Specifically, dihydroxybenzenes (e.g., hydroquinone), 3-pyrazolidones (e.g., 1-phenyl-3-pyrazolidone, 4,4-dimethyl- 1-phenyl-3-pyrazolidone), aminophenols (e.g., N-methyl-p-aminophenol), ascorbic acid, hydroxylamines and so on can be used alone or as a mixture of two or more thereof.

The silver halide photographic material of the present invention is well suited to be developed with a developer containing dihydroxybenzenes as primary developing agent and 3-pyrazolidones or aminophenols as auxiliary developing agent. In the developer, it is preferable for dihydroxybenzenes to be used in an amount of from 0.05 to 0.5 mole per liter and for 3-pyrazolidones or aminophenols to be used in an amount of at most 0.06 mole per liter (preferably not less than 0.0001 mole per liter).

Also, as disclosed in U.S. Pat. No. 4,269,929, amines can be added to the developer to increase the development speed, whereby reduction in development time can be effected.

Further, the developer can contain pH buffers such as sulfites, carbonates, borates and phosphates of alkali metals, development restrainers or antifoggants such as bromides, iodides and organic antifoggants (especially nitroindazoles or benzotriazoles), and so on. Furthermore, the developer may contain water softeners, dissolution aids, color toning agents, development accelerators, surfactants (particularly preferably the aforementioned polyalkylene oxides), defoaming agents, hardeners and silver-stain inhibitors (e.g., 2-mercaptobenzimidazole sulfonic acids), if desired.

As for the fixer, those having conventional compositions can be used. The fixing agent used in the fixer includes thiosulfates, thiocyanates, and sulfur-containing organic compounds known to act effectively as a fixing agent. In the fixer, a water-soluble aluminum salt or the like may be contained as a hardener.

The processing temperature is generally chosen from the range of 18° C. to 50° C.

For photographic processing, it is desirable to use an automatic developing machine. Even when the total processing time from the insertion of a photographic material into the automatic developing machine to its discharge therefrom, is set at a value ranging from 90 to 120 seconds, sufficiently ultra-hard negative gradation characteristics can be obtained.

In the developer for the present invention, the compounds disclosed in JP-A-56-24347 (U.S. Pat. No. 4,310,622) can be used as silver-stain inhibitor. The compounds disclosed in JP-A-61-267759 (U.S. Pat. No. 4,740,452) can be added to the developer as dissolution auxiliary aids. In addition, the compounds disclosed in JP-A-60-93433 (U.S. Pat. No. 4,569,904) can be used as pH buffers in the developer.

There is not any particular restrictions for the additives used in the photographic material of the present invention and the photographic processing method adopted therein. For instance, those described in the following patent specifications can be preferably applied to the photographic material of the present invention.

| Items | References corresponding thereto |
|---|---|
| 1. Nucleation accelerator | The compounds of general formulae (II-m) to (II-p) and Compounds II-1 to II-22 disclosed in JP-A-02-103536, from page 9, rightupper column, 13th line to page 16, left upper column, 10th line; and those disclosed in JP-A-01-179939. |
| 2. Silver halide emulsion and preparation method thereof | The selenium sensitization method disclosed in JP-A-02-97937,from page 20, right lower column, 12th line to page 21, left lower column, 14th line, and JP-A-02-12236, from page 7, right upper column, 19th line to page 8, left lower column, 12th line, and JP-05-11389. |
| 3. Spectral sensitizing dye | The sensitizing dyes disclosed in JP-A-02-12236, page 8, from left lower column, 13th line, to right lower column, 4th line; JP-A-02-103536, from page 16, right lower column, 3rd line to page 17, left lower column, 20th line; JP-A-01-112235; JP-A-02-124560; JP-A-03-7928; and JP-A-05-11389. |
| 4. Surfactant | Those disclosed in JP-A-02-1-2236, page 9, from right upper column, 7th line, to right lower column, 7th line; and JP-A-02-18542, from page 2, left lower column, 13th line to page 4, right lower column, 18th line. |
| 5. Antifoggant | The thiosulfinic acid compounds disclosed in JP-A-02-103536, from page 17, right lower column, 19th line to page 18, right upper column, 4th line, and page 18, right lower column, from 1st to 5th line; and JP-A-01-237538. |
| 6. Polymer latex | Those disclosed in JP-A-02-103536, page 18, left lower column, from 12th to 20th line. |
| 7. Acid group-containing compound | Those disclosed in JP-A-02-103536, from page 18, right lower column, 6th line, to page 19, left upper column, 1st line. |
| 8. Matting agent, Slipping agent and Plasticizer | Those disclosed in JP-A-02-103536, page 19, from left upper column, 15th line, to right upper column, 15th line. |
| 9. Hardener | Those disclosed in JP-A-02-103536, page 18, right upper column, from 5th to 17th line. |
| 10. Dye | The dyes disclosed in JP-A-02-103536, page 17, right lower column, from 1st to 18th line; and the solid dyes disclosed in JP-A-02-294638 and JP-A-05-11382. |
| 11. Binder | Those disclosed in JP-A-02-18542, page 3, right lower column, from 1st to 20th line. |
| 12. Black-spot inhibitor | The compounds disclosed in U.S. Pat. No. 4,956,257 and JP-A-01-118832. |
| 13. Monomethine compound | The compounds of general formula (II) disclosed in JP-A-02-287532 (especially, Compounds II-1 to II-26). |
| 14. Dihydroxybenzenes | The compounds disclosed in JP-A-03-39948, from page 11, left upper column, to page 12, left lower column; and EP-0452772A. |
| 15. Developer and Developing method | Those disclosed in JP-A-02-103536, from page 19, right upper column, 16th line, to page 21, left upper column, 8th line. |

EXAMPLE 1

To an aqueous gelatin solution kept at 50° C., an aqueous solution of silver nitrate and an aqueous solution of potassium iodide and potassium bromide were added simultaneously over a 60-minute period in the presence of $4\times10^{-7}$ mole/mole silver of potassium hexachloroiridate(III) and ammonia. During the addition, the pAg of the reaction system was kept at 7.8. Thus, a cubic monodisperse emulsion having an average grain size of 0.28 μm and an average iodide content of 0.3 mole % was prepared. This emulsion was desalted using the flocculation process, and thereto was added inert gelatin in an amount of 40 g per mole of silver. Thereafter, the emulsion was kept at 50° C. and thereto were added 5,5'-dichloro-9-ethyl-3,3'-bis(3 -sulfopropyl)oxacarbocyanine as a sensitizing dye and a KI solution in an amount of $10^{-3}$ mole per mole of silver. After a lapse of 15 minutes, the temperature of the emulsion was lowered. The resulting emulsion was melted again, and maintained at 40° C. Thereto was added the compounds represented by general formula (1) or (2) of the present invention, or one of comparative compounds, in an amount of $1.2\times10^{-3}$ mole per mole of silver halide, and further were added hydroquinone in an amount of 0.5 mole/mole silver, 5 -methylbenzotriazole, 4-hydroxy-1,3,3a,7-tetraazaindene, and a polyethylacrylate latex, and as a gelatin hardener was added 1,3-divinylsulfonyl-2-propanol. The thus prepared emulsion was coated on a polyester film (150 μm) having a subbing layer (0.5 μm) constituted of a vinylidene chloride copolymer so as to have a silver coverage of 3.4 g/m$^2$.

On this emulsion layer, a layer containing 1.5 g/m$^2$ of gelatin, 0.3 g/m$^2$ of polymethylmethacrylate particles (average size: 2.5 μm) and the surfactants illustrated below was provided as a protective layer.

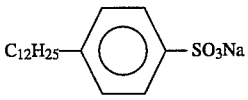

37 mg/m$^2$ $CH_2COOC_6H_{13}$
|
$CHCOOC_6H_{13}$
|
$SO_3Na$ 37 mg/m$^2$ $C_8F_{17}SO_2NCH_2COOK$
|
$C_3H_7$ 2.5 mg/m$^2$

Each of the thus obtained samples was exposed to 3200° K tungsten light through an optical wedge, and developed at 34° C. for 30 seconds with Developer A described below. Further, it was fixed, washed and then dried in a conventional manner. The photographic characteristics obtained are shown in Table 1.

TABLE 1

| Run No. | Sample No. | Hydrazine Compound | Sensitivity Difference (ΔS) | Gradient (χ) | Dmax |
|---|---|---|---|---|---|
| 1 | Comparative Sample 1 | Comparative Compound-A | (standard) | 17.3 | 4.85 |
| 2 | Comparative Sample 2 | Comparative Compound-B | −0.22 | 10.7 | 3.82 |
| 3 | Comparative Sample 3 | Comparative Compound-C | −0.31 | 10.1 | 3.71 |
| 4 | Comparative Sample 4 | Comparative Compound-D | −0.25 | 11.0 | 3.80 |
| 5 | Comparative Sample 5 | Comparative Compound-E | −0.13 | 13.1 | 4.50 |
| 6 | Comparative Sample 6 | Comparative Compound-F | −0.10 | 14.2 | 4.41 |
| 7 | Comparative Sample 7 | Comparative Compound-G | −0.19 | 15.8 | 4.20 |
| 8 | Sample 1 of the invention | Compound 8 of the Invention | −0.01 | 17.1 | 5.21 |
| 9 | Sample 2 of the Invention | Compound 9 of the Invention | −0.03 | 17.0 | 5.15 |
| 10 | Sample 3 of the Invention | Compound 11 of the Inveniton | −0.08 | 15.3 | 4.96 |
| 11 | Sample 4 of the Invention | Compound 13 of the Invention | +0.05 | 19.5 | 5.25 |
| 12 | Sample 5 of the Invention | Compound 14 of the Invention | +0.03 | 18.4 | 5.23 |
| 13 | Sample 6 of the Invention | Compound 15 of the Invention | −0,01 | 17.3 | 5.18 |
| 14 | Sample 7 of the Invention | Compound 22 of the Inveniton | −0.10 | 14.7 | 4.92 |
| 15 | Sample 8 of the Invention | Compound 27 of the Invention | −0.10 | 14.5 | 4.89 |

It can be seen from Table 1 that all the samples of the present invention provided not only a high gamma value of at least 10 as gradient but also a high Dmax value.

Sensitivity Difference (ΔS): Determined taking the sensitivity ($S_2$) (a logalithm value of exposure (E) providing density (D) of 1.5) of Comparative Sample 1 as a standard and expressed in terms of the difference between the sensitivity ($S_1$) of each sample and that ($S_2$) of the standard sample ($\Delta S=S_1-S_2$).

Gradient (γ): Shown as a gradient of the straight line connecting a point of D=0.3 and a point of D=3.0 on the characteristic curve of each sample.

Dmax: Shown as a density value which is obtained with exposure (E') of which the logalithm is larger than log E by 0.4 (i.e., log E'=log E+0.4).

The composition of the Developer A used herein was as follows:

| Developer A | |
|---|---|
| Hydroquinone | 50.0 g |
| N-Methyl-p-aminophenol | 0.3 g |
| Sodium hydroxide | 18.0 g |
| 5-Sulfosalicylic acid | 55.0 g |
| Potassium sulfite | 110.0 g |
| Disodium ethylenediaminetetraacetate | 1.0 g |
| Potassium bromide | 10.0 g |
| 5-Methylbenzotriazole | 0.4 g |
| 2-Mercaptobenzimidazole-5-sulfonic acid | 0.3 g |
| Sodium 3-(5-mercpatotetrazole)benzenesulfonate | 0.2 g |
| N-n-butyldiethanolamine | 15.0 g |
| Sodium toluenesulfonate | 8.0 g |

-continued

| Developer A | |
|---|---|
| Water to make (after adjustment of pH) | 1 l |
| pH adjusted (by the addition of KOH) to | 11.6 |

EXAMPLE 2

In addition to Developer A, there were prepared Developers B and C which were respectively different in potassium sulfite concentration from Developer A. Specifically, the potassium sulfite concentrations in Developer B and Developer C were reduced to one-half and one-third, respectively, that in Developer A.

Each of the samples prepared in Example 1 was developed using these Developer B and Developer C separately.

The photographic characteristics obtained are shown in Table 2. Therein, the sensitivity and the gradient are expressed in terms of the differences ΔS and Δγ, respectively, between the case in which Developer B ($S_B$, $\gamma_B$) or C ($S_c$, $\gamma_c$) was used for development and the case in which Developer A ($S_A$, $\gamma_A$) was used (i.e., $\Delta S=S_B$ (or $S_C$)$-S_A$, $\Delta\gamma=\gamma_B$ (or $\gamma_C$)$-\gamma_A$).

TABLE 2

| Run | | Developer B | | | Developer C | | |
|---|---|---|---|---|---|---|---|
| No. | Sample No. | ΔS | ΔX | Dmax | ΔS | ΔX | Dmax |
| 1 | Comparative Sample 1 | +0.05 | +3.0 | 4.20 | +0.12 | +5.7 | 3.61 |
| 2 | Comparative Sample 2 | +0.01 | +1.2 | 3.85 | +0.05 | +2.5 | 3.96 |
| 3 | Comparative Sample 3 | +0.01 | +1.0 | 3.80 | +0.08 | +3.8 | 3.85 |
| 4 | Comparative Sample 4 | +0.02 | +1.2 | 3.92 | +0.07 | +4.0 | 3.98 |
| 5 | Comparative Sample 5 | +0.06 | +3.7 | 4.31 | +0.12 | +5.5 | 4.25 |
| 6 | Comparative Sample 6 | +0.03 | +1.5 | 4.15 | +0.13 | +5.9 | 3.59 |
| 7 | Comparative Sample 7 | +0.05 | +5.1 | 4.03 | +0.15 | +7.2 | 3.55 |
| 8 | Sample 1 of Invention | +0.02 | +1.5 | 5.11 | +0.05 | +3.0 | 4.82 |
| 9 | Sample 2 of Invention | +0.03 | +2.0 | 4.99 | +0.05 | +2.4 | 4.71 |
| 10 | Sample 3 of Invention | +0.04 | +2.3 | 4.85 | +0.07 | +5.2 | 4.60 |
| 11 | Sample 4 of Invention | +0.01 | +0.5 | 5.07 | +0.03 | +1.5 | 4.94 |
| 12 | Sample 5 of Invention | +0.02 | +1.3 | 5.04 | +0.04 | +2.0 | 4.88 |
| 13 | Sample 6 of Invention | +0.04 | +2.1 | 5.05 | +0.07 | +4.7 | 4.85 |
| 14 | Sample 7 of Invention | +0.05 | +3.7 | 4.77 | +0.09 | +5.9 | 4.51 |
| 15 | Sample 8 of Invention | +0.05 | +3.5 | 4.73 | +0.08 | +5.5 | 4.50 |

As can be seen from Table 2, the samples of the present invention are able to provide high Dmax even when the developers reduced in the potassium sulfite concentration were used.

As shown above, the sulfite concentration dependence of the compounds of the present invention as a nucleating agent is extremely small. Since the nucleating agent of such a type have not been conceived so far, it can be said that the effects of the present invention are quite unexpected.

EXAMPLE 3

Aqueous solutions of silver nitrate and sodium chloride were added simultaneously to an aqueous gelatin solution maintained at 30° C. with stirring in the presence of $5.0\times10^{-6}$ mole/mole silver of $(NH_4)_3RhCl_6$, and therefrom was removed the soluble salt in a conventional manner. Thereto, gelatin was further added. The resulting emulsion was admixed with 2-methyl-4-hydroxy-1,3,3a-7-tetraazaindene as a stabilizer without undergoing any chemical ripening steps. The thus obtained emulsion was a monodisperse emulsion containing cubic crystallines having an average grain size of 0.15 μm.

To this emulsion, the compounds set forth in Table 3, which were selected from those represented by general formula (1) or (2) or those cited as comparative compounds, were added separately in the same amount of $7.0\times10^{-3}$ mole per mole of silver, and further were added a polyethylacrylate latex in a proportion of 30 wt % to gelatin on a solids basis, and 1,3-divinylsulfonyl-2-propanol as a gelatin hardener. Each of the thus prepared emulsions was coated on a polyester support so as to have a silver coverage of 3.8 g/m$^2$. The gelatin coverage of this coating was 1.8 g/m$^2$. On each coating, a layer containing 1.5 g/m$^2$ of gelatin and 0.3 g/m$^2$ of polymethylmethacrylate particles (average size: 2.5 μm) was provided as a protective layer.

The thus obtained samples were each exposed to light through an optical wedge by means of a daylight printer, Model P-607, products of Dainippon Screen Co., Ltd., developed at 38° C. for 20 seconds with Developer A, fixed, washed and then dried.

The photographic characteristics obtained are shown in Table 3.

TABLE 3

| Run No. | Sample No. | Hydrazine Compound | Difference Sensitivity (ΔS) | Gradient (χ) | Dmax |
|---|---|---|---|---|---|
| 1 | Comparative Sample 3-1 | Comparative Compound-A | (standard) | 12.5 | 4.72 |
| 2 | Comparative Sample 3-2 | Comparative Compound-B | −0.19 | 7.3 | 3.20 |
| 3 | Comparative Sample 3-3 | Comparative Compound-C | −0.23 | 5.7 | 2.95 |
| 4 | Comparative Sample 3-4 | Comparative Compound-D | −0.21 | 6.0 | 3.02 |
| 5 | Comparative Sample 3-5 | Comparative Compound-E | −0.03 | 9.7 | 4.25 |
| 6 | Comparative Sample 3-6 | Comparative Compound-F | −0.17 | 8.1 | 3.16 |
| 7 | Comparative Sample 3-7 | Comparative Compound-G | −0.10 | 8.7 | 3.87 |
| 8 | Sample 3-1 of Invention | Compound 8 of Invention | +0.06 | 17.2 | 5.31 |
| 9 | Sample 3-2 of Invention | Compound 9 of Invention | +0.05 | 14.1 | 5.00 |
| 10 | Sample 3-3 of Invention | Compound 11 of Invention | −0.01 | 12.5 | 4.95 |
| 11 | Sample 3-4 of Invention | Compound 13 of Invention | +0.11 | 20.4 | 5.42 |
| 12 | Sample 3-5 of Invention | Compound 14 of Invention | +0.08 | 18.8 | 5.33 |
| 13 | Sample 3-6 of Invention | Compound 15 of Invention | +0.06 | 17.0 | 5.20 |
| 14 | Sample 3-7 of Invention | Compound 22 of Invention | −0.09 | 10.2 | 4.77 |
| 15 | Sample 3-8 of Invention | Compound 27 of Invention | −0.10 | 10.2 | 4.75 |

As can be seen from Table 3, high gradient (high gamma values) was achieved by the samples of the present invention.

EXAMPLE 4

The samples which has proved in Example 3 to be hard sufficient to have a gamma value of at least 8 were each subjected to the following photographic processing.

Specifically, each sample was exposed to light through an optical wedge and a plain halftone screen (dotsarea percent: 50%) by means of a daylight printer, Model P- 607, products of Dainippon Screen Co., Ltd., and then developed at 38° C. for 20 seconds. The development was carried out using Developer A, Developer B and Developer C separately. Further, fixation, washing and drying steps were successively carried out in a conventional manner. Each sample was examined for the changes of dots-area percent obtained by the exposure using the exposure amount providing the dots-area percent of 50% when the development was carried out using Developer A and the development using Developer B and C separately. The results obtained are shown in Table 4.

In addition, each sample was examined for Dmax values of the images formed therein via the exposure through the optical wedge alone and the same photographic processing as described above. These values also are shown in Table 4.

TABLE 4

| Run No. | Sample No. | Developer B Change in Dots-area % | Developer B Dmax | Developer C Change in Dots-area % | Developer C Dmax |
|---|---|---|---|---|---|
| 1 | Comparative Sample 3-1 | +2% | 4.05 | +5% | 3.30 |
| 2 | Comparative Sample 3-5 | +2% | 4.12 | +4% | 3.79 |
| 3 | Comparative Sample 3-6 | +3% | 3.02 | +6% | 2.85 |
| 4 | Comparative Sample 3-7 | +4% | 3.21 | +8% | 2.86 |
| 5 | Sample 3-1 of Invention | +1% | 5.06 | +3% | 4.72 |
| 6 | Sample 3-2 of Invention | +1% | 4.74 | +3% | 4.43 |
| 7 | Sample 3-3 of Invention | +2% | 4.61 | +4% | 4.30 |
| 8 | Sample 3-4 of Invention | ±0% | 5.18 | +1% | 4.97 |
| 9 | Sample 3-5 of Invention | ±0% | 5.16 | +2% | 4.91 |
| 10 | Sample 3-6 of Invention | +1% | 5.10 | +2% | 4.75 |
| 11 | Sample 3-7 of Invention | +2% | 4.55 | +4% | 4.25 |
| 12 | Sample 3-8 of Invention | +2% | 4.56 | +4% | 4.21 |

As can be seen from Table 4, the samples of the present invention succeed in achievement of high Dmax values even when the developers having reduced sulfite concentrations are used, and the sulfite-concentration dependence of the dots-area percent is quite small.

While the invention has been described in detail and with reference to specific embodiments thereof, it will be apparent to one skilled in the art that various changes and modifications can be made therein without departing from the spirit and scope thereof.

What is claimed is:

1. A silver halide photographic material having on a support at least one light-sensitive silver halide emulsion layer, wherein said emulsion layer, a hydrophilic colloid layer adjacent thereto, or both, contain at least one compound selected from the group consisting of compounds represented by general formula (1) or (2):

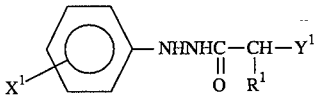

(1)

wherein $X^1$ represents an alkyl group, an alkoxy group, an amino group or an alkylthio group, and the total number of carbon atoms contained in $X^1$ ranges from 1 to 6;

$Y^1$ represents an alkyl substituted aryloxy group; and $R^1$ represents hydrogen, an alkyl group or an aryl group, and the total number of carbon atoms contained in $Y^1$ and $R^1$ ranges from 4 to 30;

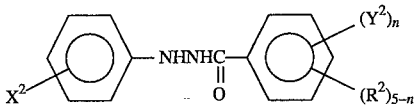

(2)

wherein $X^2$ has the same meaning as $X^1$ in general formula (1);

$Y^2$ represents an electron withdrawing group;

$R^2$ represents hydrogen, an alkyl group, an aryl group, an alkoxy group, an aryloxy group, an amino group, an alkylthio group, or an arylthio group;

n represents an integer of from 1 to 5; and plural $Y^2$ or $R^2$ groups may be the same or different.

2. The silver halide photographic material of claim 1, wherein $X^1$ and $X^2$ each is an amino group.

3. The silver halide photographic material of claim 1, wherein the substituent of said substituted amino group represented by $X^1$ or $X^2$ is a group selected from the group consisting of an alkyl group, an aryl group, an acyl group, an alkoxycarbonyl group, a carbamoyl group, a hydrazinocarbonyl group, an alkylsulfonyl group, an arylsulfonyl group, and a sulfamoyl group.

4. The silver halide photographic material of claim 1, wherein the substituent for substitution of said groups represented by $X^1$ or $X^2$ is a group selected from the group consisting of an alkyl group, an alkoxy group, an alkoxyalkoxy group, an aryloxy group, an aryl group, and a hydroxy group.

5. The silver halide photographic material of claim 3, wherein said substituent is an acyl group, a carbamoyl group, an alkylsulfonyl group, or a substituted or unsubstituted arylsulfonyl group.

6. The silver halide photographic material of claim 1, wherein $Y^1$ is a t-amyl substituted aryloxy group.

7. The silver halide photographic material of claim 1, wherein the substitution position of $X^1$ and $X^2$ on the phenyl group in general formulae (1) and (2), respectively, is the meta or para position with respect to the hydrazino moiety in general formulae (1) and (2), respectively.

8. The silver halide photographic material of claim 1, wherein the substitution position of $X^1$ on the phenyl group in general formula (1) is the para position with respect to the hydrazino moiety in general formula (1).

9. The silver halide photographic material of claim 1, represented by $Y^1$, $R^1$, or $R^2$ is a group selected from the wherein the substituent for substitution of said group group consisting of an alkyl group, an aralkyl group, an alkenyl group, an alkinyl group, an alkoxy group, an aryl group, an amino group, an ureido group, a carbamoyloxy group, an alkoxycarbonylamino group, an aryloxycarbonylamino group, an aryloxy group, a sulfamoyl group, a carbamoyl group, an alkylthio group, an arylthio group, an alkylsulfonyl group, an arylsulfonyl gorup, an alkylsulfinyl group, an arylsulfinyl group, a hydroxy group, a halogen atom, a cyano gorup, —$SO_3M$ (wherein M represents a hydrogen atom, an alkali metal atom or $NH_4$), an aryloxycarbonyl group, an acyl group, an alkoxycarbonyl group, an acyloxy group, a carbonamido group, a sulfonamido group, —COOM (wherein M represents a hydrogen atom, an alkali metal atom or $NH_4$), a phosphonamido group, a diacylamino group, and an imido group.

10. The silver halide photographic material of claim 1, wherein said electron withdrawing group represented by $Y^2$ has a substituent constant value $\sigma_m$ or $\sigma_p$ of at least 0.2.

11. The silver halide photographic material of claim 10, wherein $Y^2$ is situated at the position meta to the carbonyl group in general formula (2) when it has a σm value of at least 0.2 or situated at the position para to the carbonyl group when it has a $\sigma_p$ value of at least 0.2, and Y is situated at the positions meta and/or para to the carbonyl group when $\sigma_m$ and $\sigma_p$ values of $Y^2$ are both at least 0.2.

12. The silver halide photographic material of claim 1, wherein said electron withdrawing group represented by $Y^2$ is a group selected from the group consisting of a sulfamoyl group, a carbamoyl group, an alkylsulfonyl group, an arylsulfonyl group, an alkylsulfinyl group, an arylsulfinyl group, a halogen atom, a cyano group, an alkyloxycarbonyl, an aryloxycarbonyl group, an acyl group, a polyfuoroalkyl group and a polyfluoroaryl group.

13. The silver halide photographic material of claim 10, wherein said electron withdrawing group represented by $Y^2$ has a substituent selected from the group consisting of an alkyl group, an aralkyl group, an alkenyl group, an alkinyl group, an alkoxy group, an aryl group, an amino group, an ureido group, a carbamoyloxy group, an alkoxycarbonylamino group, an aryloxycarbonyl amino group, an aryloxy group, a sulfamoyl group, a carbamoyl group, an alkylthio group, an arylthio group, an alkylsulfonyl group, an arylsulfonyl gorup, an alkylsulfinyl group, an arylsulfinyl group, a hydroxy group, a halogen atom, a cyano gorup, —$SO_3M$ (wherein M represents a hydrogen atom, an alkali metal atom or $NH_4$), an aryloxycarbonyl group, an acyl group, an alkoxycarbonyl group, an acyloxy group, a carbonamido group, a sulfonamido group, —COOM (wherein M represents a hydrogen atom, an alkali metal atom or $NH_4$), a phosphonamido group, a diacylamino group, and an imido group.

14. The silver halide photographic material of claim 1, wherein the total number of the carbon atoms contained in all $Y^2$ groups and all $R^2$ groups is in the range of 6 to 30.

15. The silver halide photographic material of claim 1, wherein said compound is incorporated into the photographic material in an amount ranging from $1\times10^{-6}$ to $5\times10^{-2}$ mole per mole of silver halide in the photographic material.

16. The silver halide photographic material of claim 1, wherein said compound is incorporated into at least one of said emulsion layer.

17. The silver halide photographic material according to claim 1 wherein said group represented by $X^1$ is substituted with a substituent selected from the group consisting of an alkyl group, an alkoxy group, and alkoxyalkoxy group, an aryloxy group, an aryl group, and a hydroxy group.

18. The silver halide photographic material according to claim 1 wherein said amino group represented by $X^1$ is a substituted amino group having a substituent selected from the group consisting of an alkyl group, an aryl group, an acyl group, an alkoxycarbonyl group, a carbamoyl group, a hydrazinocarbonyl group, an alkylsulfonyl group, an arylsulfonyl group, and a sulfamoyl group.

19. The silver halide photographic material according to claim 1 wherein $R^2$ is substituted by a substitutent selected from the group consisting of an alkyl group, an aralkyl group, an alkenyl group, an alkinyl group, an alkoxy group, an aryl group, an amino group, an ureido group, an urethane group, an aryloxy group, a sulfamoyl group, a carbamoyl group, an alkylthio group, an arylthio group, an alkylsulfonyl group, an arylsulfonyl group, a alkylsulfinyl group, an arylsulfinyl group, a hydroxy group, a halogen atom, a cyano group, a sulfo group, an aryloxycarbonyl group, an acyl group, an alkoxycarbonyl group, an acyloxy group, a carbonamido group, a sulfonoamido group, a carboxyl group, a phosphonamido group, a diacylamino group, and an imido group.

20. The silver halide photographic material according to claim 1 wherein said amino group represented by $R^2$ is a substituted amino group having a subsitutent selected from the group consisting of an alkyl group, an aryl group, an acyl group of an alkyl group or an aryl group, an alkoxycarbonyl group, an aryloxycarbonyl group, a carbamoyl group, a hydrazinocarbonyl group, an alkylsulfonyl group, an arylsulfonyl group, and a sulfamoyl group.

* * * * *